United States Patent [19]

Wittmann

[11] 4,268,062

[45] May 19, 1981

[54] SOLE SUPPORT PLATE

[75] Inventor: Heinz Wittmann, Vienna, Austria

[73] Assignee: TMC Corporation, Baar, Switzerland

[21] Appl. No.: 57,103

[22] Filed: Jul. 12, 1979

[30] Foreign Application Priority Data

Jul. 17, 1978 [AT] Austria ..... 5143/78
Mar. 21, 1979 [AT] Austria ..... 2099/79

[51] Int. Cl.[3] ..... A63C 9/00
[52] U.S. Cl. ..... 280/611; 280/618
[58] Field of Search ..... 280/618, 620, 633, 611, 280/615, 617

[56] References Cited

U.S. PATENT DOCUMENTS 4,073,509 2/1978 Gertsch ..... 280/620 X
4,191,396 3/1980 Biermann et al. ..... 280/618 X

FOREIGN PATENT DOCUMENTS 2363662 8/1974 Fed. Rep. of Germany ..... 280/633

*Primary Examiner*—John P. Silverstrim
*Assistant Examiner*—Michael Mar
*Attorney, Agent, or Firm*—Blanchard, Flynn, Thiel, Boutell & Tanis

[57] ABSTRACT

A sole support plate for ski bindings, which can be releasably fixed on a ski-fixed base plate, bottom plate or the like of a ski binding part and which has a recess on its underside, which recess rests with its bottom surface on the upper side of the base plate, bottom plate or the like and which has on each of two opposite and vertically extending side surfaces a groove, by means of which the sole support plate can be mounted on corresponding guideways of the base plate, bottom plate or the like and can be locked in an offset part of the latter, wherein in the area of the recess there is provided a cavity, which can engage or disengage from the offset part of the base plate, bottom plate or the like, and wherein in the mounted condition of the sole support plate, fastening screws of the base plate, bottom plate or the like are covered up.

4 Claims, 6 Drawing Figures

SOLE SUPPORT PLATE

FIELD OF THE INVENTION

This invention relates to a sole support plate for use in supporting the sole of ski boots on a ski.

BACKGROUND OF THE INVENTION

Such sole support plates have been known for a long time in many various embodiments. They consist for expense reasons almost exclusively of a plastic material, wherein the area on which the sole of the ski boot rests consists in most cases of a material having a low frictional resistance characteristic. In this manner, the release force is not increased additionally and in an undesired manner through friction which is produced between the ski boot and the sole support plate. Rather a reduction of the frictional forces is achieved.

Fastening of conventional sole support plates occurs mostly by means of screws, which often simultaneously extend through the base plate, bottom plate or the like of the ski binding part, to which they belong. Such a type of fastening is disadvantageous for two reasons. First of all, the fastening screws are exposed to icing up and to dirt, which results in their possible necessary release to encounter difficulties. Since the sole support plates which consist of a plastic material are generally exposed to a greater wear than the base plates, bottom plates or the like of the ski binding part, which plates consist of metal, the screws which also hold the ski binding parts must be released, if a damaged sole support plate must be exchanged. This in turn has the danger of the fastening screws for the ski binding part becoming loose. If, however, the sole support plate is fixed with separate screws on the upper side of the ski, the body of the ski is weakened in an undesired manner by the provision of additional screws.

According to Austrian Pat. No. 327 760 a sole support plate, consisting of a support member which can be fastened on the upper side of the ski, with sliding strips which are mounted on its upper side is known, wherein the sliding strips and the support member can engage one another by means of a recess and by means of a correspondingly shaped holding element. It is furthermore known according to Austrian Pat. No. 315 701 to secure the sole support plate sunk in a recess of the support member, wherein in-running sides of the sole support plate are constructed with a slope.

A sole support plate of the above-mentioned type has become known through products which can be obtained on the market. In this conventional construction the sole support plate is moved on over a guide rail in the direction of the ski binding, wherein said guide rail corresponds approximately with the length of the sole support plate and carries the offset part in its end zone which is remote from the ski binding, with which offset part a counter-notched part of the sole support plate can engage. It is disadvantageous that the rail extends with the sole support plate starting from the ski binding in direction of the other ski binding part because it increases the entire length of the ski binding. Such an embodiment is disadvantageous in view of the reinforcement of the ski. A further disadvantage of the conventional sole support mechanism lies in that the engagement between the rail and the sole support plate is due to the small construction, so that a small impact on the sole support plate can result in an undesired separation of the same from the rail. An arbitrary separation of the sole support plate can be performed by means of a screw driver; the easier it is to carry out the detaching procedure, the easier it is for an arbitrary separation, as was described above, to occur. A detaching procedure which is difficult to perform, however, can in turn result in damage (tear formation) to the sole support plate. This known solution has been published also in print in the instructions for use, which are associated with the product.

The purpose of the invention is now to aid and to design a sole support plate of the above-mentioned type such that it holds securely in a condition of use thereof, the detaching procedure can be performed easily and the guideways of the ski binding part for the base plate, bottom plate or the like do not take on undesired long dimensions.

The set purpose is inventively attained by the offset part being provided on the free end of a tonguelike locking part which extends longitudinally of the ski and away from the base plate, bottom plate or the like into the direction which is remote from the ski binding part, wherein a cavity is provided on or rather in the bottom surface of the recess in the sole support plate. In this manner, it is possible to partly directly mount the sole support plate onto the base plate, bottom plate or the like of the ski binding part and to lock it thereon, without requiring the use of separate guideways. In this manner, it is possible to build the ski binding together with the sole support plate in a compact manner. The locking connection between the receiving point and the locking part practically eliminates an undesired release of the sole support plate from the base plate, bottom plate or the like. In spite of this, a voluntary release of the sole support plate can be performed without any problems.

A particularly preferable embodiment of the invention consists in the cavity having therein a step which cooperates with a step of the offset part of the locking part and which prevents an automatic release of the sole support plate from the bottom plate or the like, wherein the free end of the offset part lies in the same plane as the underside of the locking part. This type of locking delivers on the one hand a secure connection between the sole support plate and the base plate, bottom plate or the like of the ski binding part, which serves as a mounting therefor, wherein the locking is sufficient also in the case of a relatively small overlapping of the two steps. This in turn results in the sole support plate being, if needed, able to be released in a simple manner from the base plate, bottom plate or the like.

A further characteristic of the invention consists in the provision of a recess for receiving a suitable tool therein, for example a screwdriver. The recess is provided approximately in the center area of a side edge of the sole support plate, through which recess the end of the sole support plate remote from the ski binding part can be tilted and through this, the engagement between the step of the cavity and the step of the locking part can be cancelled. In this manner the release of the sole support plate from the base plate, bottom plate or the like is particularly simple.

For a better support of the sole support plate on the base plate, bottom plate or the like, it is furthermore inventively provided that the base plate, bottom plate or the like has elevations which are constructed as projections on its side which faces the upper side of the ski and in the area where it is fastened in a conventional manner by means of screws on the ski, and that the sole support plate has two holding tabs, each of which is located between one of the projections and the locking part. The sole support plate is constructed supportingly on the structural parts of the base plate, bottom plate or the like.

The sole support plate which has been described thus far has proven to be successful in practice, however, it has a disadvantage insofar as the attachment or detachment procedure is concerned, in particular the latter, in that it can be performed only with a relatively large force. Such a procedure is without any disadvantage worth mentioning during the attaching procedure of individual ski bindings, however, in the case of a mounting in mass production, as it occurs in the trade in this field, a repeated generation of a large force is undesired. The invention has now the purpose to also produce in this respect a perfect solution.

This further purpose is inventively attained by the step of the cavity being determined by a connecting part, which bridges an extension of the bottom plate recess and thus is constructed elastically flexible in an elevational direction.

Through the inventive measure the connecting part which determines the step of the cavity is elastically flexible in an elevational direction, so that said part can give way insignificantly during an attaching or detaching procedure, which causes the force input which is necessary for this operation to be substantially reduced compared with the known solution.

BRIEF DESCRIPTION OF THE DRAWINGS

Further details, advantages and characteristics of the invention will be described in more detail with reference to the drawings, which illustrate one exemplary embodiment.

In the drawings.

DETAILED DESCRIPTION

Figure 3:
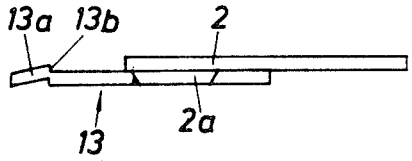
FIG. 3 is a side view of the locking part according to FIG. 2.

In the now following description only those parts of a safety ski binding are illustrated and described which are necessary for explaining the locking feature of an inventive sole support plate 1. The sole support plate 1 has in the direction of a base plate, bottom plate 2 or the like—hereinafter bottom plate 2—of a safety ski binding a slightly, however, continuously enlarging shape. The underside 3 of the sole support plate 1 is flat and extends in a plane and has a recess therein which will yet be described in more detail. The side edges 4 of the sole support plate 1 are oriented substantially perpendicularly relative to the upper surface of a ski (not illustrated). The two corner regions 5 of the sole support plate 1 remote from the bottom plate 2 are each rounded off with a radius. The side of the sole support plate 1 remote from the bottom plate 2 has a chamfer 8 which defines a surface extending perpendicularly to the upper surface of the ski (not illustrated) and which corresponds with the size of the structural part. A surface **6*a* inclined to the horizontal at an angle of about 30° extends upwardly away from the upper edge of the chamfer 8 and is transformed into a support part 6*b* on the upper side 6 of the sole support plate 1, which support part 6*b* extends substantially parallel with respect to the planar underside 3 of the sole support plate 1**.

Figure 1:
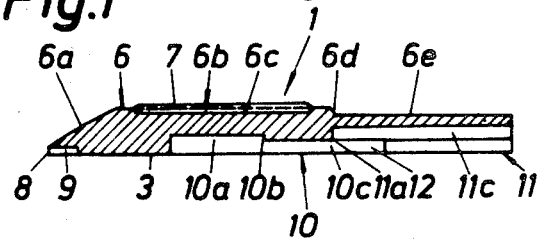
FIG. 1 is a cross-sectional view of an inventive sole support plate.

A recess **6*c* of uniform depth and with a substantially rectangular base is provided in the support part 6*b*. The recess 6*c* leaves a narrow, approximately equally wide edge, which is not identified in detail on the support part 6*b*. The corner areas of the recess 6*c* are rounded off by individual radii. The recess 6*c* is used to receive a small plate 7, which consists of a material, preferably polytetrafluoroethylene, which has a low friction coefficient characteristic. The small plate 7, the shape of which corresponds approximately with the shape of the recess 6*c*, is designed sufficiently thick that it slightly projects above the upper surface of the support part 6*b* (see FIG. 1**).

In a direction toward the bottom plate 2, the support part **6*b* is followed by a sloped surface area 6*d* of approximately 45°, which extends to an end part 6*e* which is oriented slightly lower than the surface of the support part 6*b*. The upper surface (not identified in detail) of the end part 6*e* extends substantially parallel with respect to the plane of the underside 3 of the sole support plate 1**.

A relatively small rectangular recess or notch 9 is located starting out from the lower end of the chamfer 8 on the underside 3 of the sole support plate 1 in the region of the longitudinal axis and is symmetrical with respect to same. The depth of the recess 9 corresponds approximately with the height of the chamfer 8. A further and elongated recess 10 is provided in the underside 3 of the sole support plate 1, which recess has one end thereof located below the small Teflon plate 7, and extends in a direction toward the bottom plate 2.

The recess 10 has a substantially rectangular shape and is designed slightly wider than the recess or notch 9. The recess 10 has a cavity **10*a* therein. The length of the cavity 10*a* is designed approximately half as long as the small Teflon plate 7 and is provided approximately in the longitudinal center of the same. The cavity extends from a position located at one side of the geometric center of the plate 7, which side is remote from the bottom plate 2. The recess 10 transfers into a connecting part 10*c* having a step 10*b* which is substantially rectangular and is positioned at a right angle with respect to the longitudinal axis of the sole plate, which means that the connecting part 10*c* is less deep than the cavity 10*a*. Both the cavity 10*a* and also the connecting part 10*c* of the recess 10** have a uniform depth.

A bottom plate receiving recess 11 with a further step **11*a* follows the connecting part 10*c* of the recess 10 approximately in the region of the sole support plate 1 and is positioned below the sloped area 6*d*. The entire depth of the recess 10 and the bottom plate receiving recess 11 corresponds approximately to two-thirds of the thickness of the end part 6*e* of the sole support plate 1. The bottom plate receiving recess 11 opens outwardly in a direction facing away from the underside 3 of the sole support plate 1. The corner regions of the bottom plate receiving recess 11 which are adjacent the step 11*a*, are each rounded off with a radius 11*b*. These radii 11*b* are approximately just as large as those on the bottom plate 2 which operatively mate with the corner regions. The width of the bottom plate receiving recess 11 is slightly larger than the width of the bottom plate 2**.

The sidewalls 11*c* of the bottom plate recess 11 are designed so that they slightly grip over a portion of the bottom plate 2. A holding tab 12 is provided laterally of the recess 10 and projects beyond the step 11*a* toward the free end (right end) of the end part 6*e*. The sidewall (not identified in detail) of the recess 10 transfers through a radius into the holding tabs 12. The holding tabs 12 have a semicircular notch 12*a* bordering same and the sidewalls 11*c* of the bottom plate receiving recess 11. The length of the holding tabs 12 corresponds approximately with the diameter of the semicircular notches 12*a*.

The bottom plate 2, which is not part of the subject matter of the invention, has on its underside in the region of each of the corners a projection 2*a*, and in the middle of each thereof is provided a screw receiving hole 2*a'*. A tonguelike locking part 13 is fixedly connected to the bottom plate 2 by means of rivets 13*c* on the longitudinal center of the bottom plate 2 and symmetrically with respect to same. The locking part 13 projects beyond the bottom plate 2. The end of the locking part 13, which lies under the bottom plate 2, has a rounded-off portion, the radius of which corresponds approximately with half of the width of the locking part 13. The locking part 13 has in the region of the free end, namely, that end remote from the bottom plate 2, an offset part 13*a*. The offset part 13*a* forms with the remaining locking part 13 on its upper side (not identified) a step 13*b*, which is designed substantially rectangularly. Starting out from the step 13*b*, the offset part 13*a* extends in a direction toward the ski (not shown) and terminates with its free end in the same plane as the underside of the locking part 13.

The spacing of the step 13*b* from the bottom plate 2 corresponds approximately with the spacing between the bottom plate receiving recess 11 and the step 10*b*.

Figure 2:
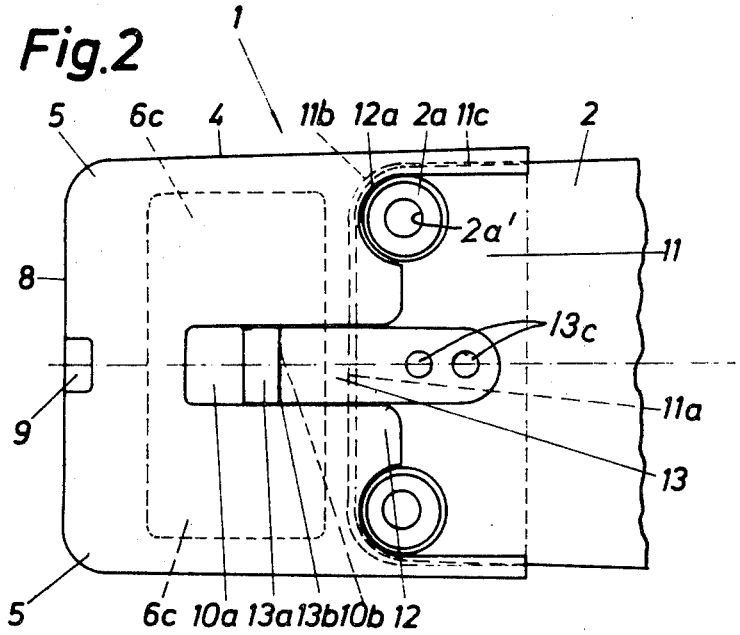
FIG. 2 is a bottom view of FIG. 1 with an associated locking part which is provided on a base plate, bottom plate or the like of a safety ski binding.

The mounting of the sole support plate 1 on the bottom plate 2 is designed now extremely simple. First one moves the sole support plate 1 onto the bottom plate 2 so that the tonguelike locking part 13 will extend between the two holding tabs 12 in the recess. Subsequently the sole support plate 1 is moved until the step 13*b* has engaged the step 10*b* of the recess 10. Due to the fact that the sole support plate 1 is correspondingly constructed with the bottom plate and in those areas in which it makes contact with the bottom plate 2, the position of the sole support plate 1 becomes fixed. This position is obtained if one imagines the sole support plate 1 according to FIG. 1 encased within the locking part 13 according to FIG. 3. FIG. 2 illustrates this condition in a bottom view.

To remove the sole support plate 1, a screwdriver or a similar tool is moved into the recess 9 and slightly lifts the sole support plate 1 off from the ski. The lifting action makes it possible to lift off the sole support plate 1 from the ski (not shown) until the step 13*b* of the locking part 13 becomes disengaged from the step 10*b* of the recess 10. Subsequently, the sole support plate 1 can be pulled off unhindered from the bottom plate 2. The operation of the mounting and removal of the sole support plate 1 can be repeated as often as desired, without resulting in damage to the plate and also without the necessity of releasing the holding screws holding the bottom plate to the ski or to the binding. In the mounted condition of the sole support plate 1, the sole support plate covers the fastening screws (not shown) for the bottom plate 2.

Figure 6:
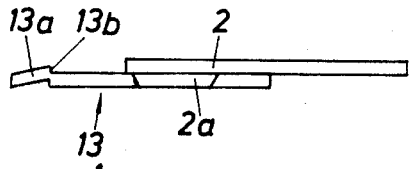
FIGS. 4 to 6 are a modified embodiment similar, respectively, to FIGS. 1 to 3.
Figure 4:
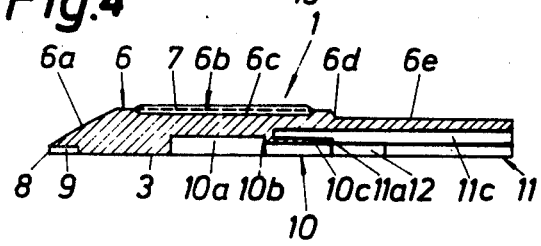
Figure 5:
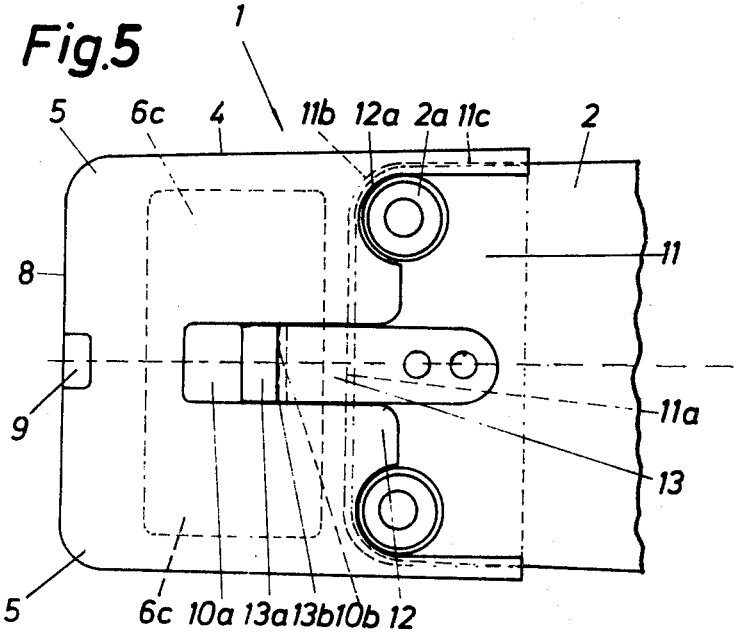

The embodiment according to FIGS. 4 to 6 illustrates a modified embodiment of the invention. The bottom plate receiving recess 11 is extended in the direction of the connecting part 10*c* and is bridged by same so that the connecting part 10*c* has a certain elasticity in the vertical direction. As a result, engagement or disengagement can be performed easier than in the embodiment according to FIGS. 1 to 3.

The invention is not limited to the illustrated exemplary embodiments. Further modifications are possible without departing from the scope of the invention. For example, the binding-fixed structural part, namely the bottom plate, can also have two tonguelike locking parts, each of which can engage or disengage a recess in the sole support plate. Furthermore, the sole support plate can be associated not only with the bottom plate but also with a different ski-fixed structural part of the ski binding.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a sole support plate for ski bindings releasably fixed to a ski-fixed means of a ski binding part, said ski-fixed means having laterally spaced guideways thereon, an offset part and a recess on its underside, a bottom surface of said recess resting on the upper side of said ski-fixed means, said recess having a groove on each of two laterally spaced and vertically extending side surfaces, said grooves receiving said guideways therein, said sole support plate having a cavity in the region of said recess adapted to releasably receive therein said offset part of said ski-fixed means, the improvement comprising wherein said offset part is provided on the free end of a tonguelike locking part which extends longitudinally of said ski away from said ski-fixed means and includes a first step, wherein said cavity is provided in said bottom surface of said recess in said sole support plate and includes a second step operatively engaged with said first step to prevent inadvertent release of said sole support plate from said ski-fixed means, and wherein said offset part at the end of said locking part extends away from said first step and terminates in a plane defined by the underside of said locking part.

2. In a sole support plate for ski bindings releasably fixed to a ski-fixed means of a ski binding part, said ski-fixed means having laterally spaced guideways thereon, an offset part and a recess on its underside, a bottom surface of said recess resting on the upper side of said ski-fixed means, said recess having a groove on each of two laterally spaced and vertically extending side surfaces, said grooves receiving said guideways therein, said sole support plate having a cavity in the region of said recess adapted to releasably receive therein said offset part of said ski-fixed means, the improvement comprising wherein said offset part is provided on the free end of a tonguelike locking part which extends longitudinally of said ski away from said ski-fixed means and includes a first step, wherein said cavity is provided in said bottom surface of said recess in said sole support plate and includes a second step operatively engaged with said first step to prevent inadvertent release of said sole support plate from said ski-fixed means, and wherein said offset part at the end of said locking part extends away from said first step and terminates in a plane defined by the underside of said locking part and includes a second step operatively engaged with said first step to prevent inadvertent release of said sole support plate from said ski-fixed means, and including a second recess located on a side edge of said sole support plate, whereby a tool inserted in said second recess may be used to effect a tilting of said sole support plate sufficiently to effect a release of said operative engagement between said first and second steps.

3. In a sole support plate for ski bindings releasably fixed to a ski-fixed means of a ski binding part, said ski-fixed means having laterally spaced guideways thereon, an offset part and a recess on its underside, a bottom surface of said recess resting on the upper side of said ski-fixed means, said recess having a groove on each of two laterally spaced and vertically extending side surfaces, said grooves receiving said guideways therein, said sole support plate having a cavity in the region of said recess adapted to releasably receive therein said offset part of said ski-fixed means, the improvement comprising wherein said offset part is provided on the free end of a tonguelike locking part which extends longitudinally of said ski away from said ski-fixed means and includes a first step, wherein said cavity is provided in said bottom surface of said recess in said sole support plate and includes a second step operatively engaged with said first step to prevent inadvertent release of said sole support plate from said ski-fixed means, and wherein said offset part at the end of said locking part extends away from said first step and terminates in a plane defined by the underside of said locking part, wherein said ski-fixed means includes a projection provided on each side of and laterally spaced from said tonguelike locking part, and wherein said sole support plate includes a pair of spaced holding tabs, each engaged between said locking part and a respective said projection.

4. In a sole support plate for ski bindings releasably fixed to a ski-fixed means of a ski binding part, said ski-fixed means having laterally spaced guideways thereon, an offset part and a recess on its underside, a bottom surface of said recess resting on the upper side of said ski-fixed means, said recess having a groove on each of two laterally spaced and vertically extending side surfaces, said grooves receiving said guideways therein, said sole support plate having a cavity in the region of said recess adapted to releasably receive therein said offset part of said ski-fixed means, the improvement comprising wherein said offset part is provided on the free end of a tonguelike locking part which extends longitudinally of said ski away from said ski-fixed means and includes a first step, wherein said cavity is provided in said bottom surface of said recess in said sole support plate and includes a second step operatively engaged with said first step to prevent inadvertent release of said sole support plate from said ski-fixed means, and wherein said offset part at the end of said locking part extends away from said first step and terminates in a plane defined by the underside of said locking part, wherein said recess includes an extending part thereof and including a connecting part which bridges said extending part of said recess, is elastically flexible in an upward direction, and defines a second step operatively engaged with said first step to prevent inadvertent release of said sole support plate from said ski-fixed means.

* * * * *